US005542234A

United States Patent [19]

Wyslotsky et al.

[11] Patent Number: 5,542,234

[45] **Date of Patent: *Aug. 6, 1996**

[54] IMPROVED METHOD OF PROVIDING RESEALABLE CONTAINERS AND MATCHING LOCKABLE LIDS

[75] Inventors: Ihor Wyslotsky, Rolling Meadows, Ill.; Frank C. Mello, Zeeland, Mich.

[73] Assignee: Sara Lee Corporation, Chicago, Ill.

[ * ] Notice: The term of this patent shall not extend beyond the expiration date of Pat. No. 5,054,266.

[21] Appl. No.: 232,428

[22] Filed: Apr. 21, 1994

Related U.S. Application Data

[63] Continuation of Ser. No. 73,279, Jun. 4, 1993, abandoned, which is a continuation of Ser. No. 859,678, Mar. 30, 1992, abandoned, which is a continuation of Ser. No. 711,162, Jun. 5, 1991, abandoned, which is a continuation-in-part of Ser. No. 526,453, Jul. 23, 1990, abandoned, which is a continuation of Ser. No. 443,606, Nov. 30, 1989, abandoned, which is a continuation-in-part of Ser. No. 239,517, Sep. 1, 1988, abandoned.

[51] Int. Cl.[6] ..... B65B 1/24; B65B 7/28; B65B 31/02; B65B 47/00

[52] U.S. Cl. ..... 53/433; 53/436; 53/453; 53/487

[58] Field of Search ..... 53/433, 436, 453, 53/454, 487, 488, 490, 139.2, 559, 560

[56] References Cited

U.S. PATENT DOCUMENTS

| | | | |
|---|---|---|---|
| 2,513,852 | 7/1950 | Donofrio | 53/454 |
| 3,057,537 | 10/1962 | Pollick | 229/1.5 B |
| 3,061,984 | 11/1962 | Mahaffy | 53/453 |
| 3,127,718 | 4/1964 | Arcudi | 53/560 X |
| 3,245,197 | 4/1966 | Van Mil | 53/560 X |
| 3,388,827 | 6/1968 | Thanhauser | 220/307 |
| 3,430,411 | 3/1969 | Ollier | 53/487 X |
| 3,509,686 | 5/1970 | Bergstrom | 53/511 |
| 4,229,927 | 10/1980 | Day | 53/433 |
| 4,277,931 | 7/1981 | Mahaffy | 53/433 X |
| 4,411,122 | 10/1983 | Cornish | 53/436 |
| 4,437,293 | 3/1984 | Sanborn | 53/139.2 |
| 4,642,972 | 2/1987 | Guiffray | 53/453 |
| 4,862,676 | 9/1989 | Mancini | 53/559 X |
| 4,945,710 | 8/1990 | Hustad | 53/436 |
| 5,054,266 | 10/1991 | Mello | 53/487 X |

OTHER PUBLICATIONS

Curwood 220R Semi-Rigid Packaging Machine Specification, dated Nov. 7, 1979.

*Primary Examiner*—Linda Johnson
*Attorney, Agent, or Firm*—Hill, Steadman & Simpson

[57] ABSTRACT

The present invention is directed to an improved combination comprising a resealable container with a matching lockable lid and methods of formation "in-line" and use thereof. The container includes a rounded container lip near the top extremity of the container. The matching lid includes a substantially rounded lid lip which is slightly larger than and of substantially the same shape as the lip for the container. The transverse cross-sectional shape of the lid lip is that of a substantially smooth curve, and the transverse cross-sectional shape of the container lip for receiving, engaging and compressing the smooth curve of the lid lip is substantially V-shaped in order to exert force upon the smooth curve of the lid lip after mating engagement for effectuating a seal therebetween. The novel features of the container and lid hereof are such that they may be formed separately on separate machines or may in other embodiments be formed and used "in-line".

18 Claims, 2 Drawing Sheets

IMPROVED METHOD OF PROVIDING RESEALABLE CONTAINERS AND MATCHING LOCKABLE LIDS

This is a continuation of application Ser. No. 073,279 filed on Jun. 4, 1993, which is a continuation of application Ser. No. 859,678 filed on Mar. 30, 1992, which is a continuation of application Ser. No. 711,162 filed on Jun. 5, 1991, which is a continuation in part of application Ser. No. 526,453 filed on Jul. 23, 1990, which is a continuation of Ser. No. 443,606 filed on Nov. 30, 1989, which is a continuation-in-part of application Ser. No. 239,517 filed on Sep. 1, 1988, all abandoned.

BACKGROUND OF THE INVENTION

The present invention is directed to containers in general, and more particularly to an improved resealable container in combination with a matching substantially lockable lid.

In the prior art, various types of containers with various types of matching lid structures have been proposed. It has been desirable that a positive engagement which is readily detectable to the user be made between a lid and a container, such that the user can determine with confidence when the lid and the container have been thus engaged. In order to facilitate that purpose, it has been desirable to provide a lid which will by tactile sensation indicate affirmatively its engagement with a matching structure of a container. In such circumstances, an audible "pop" which occurs when the lid affirmatively engages a matching structure in the container has also been deemed to be a desirable feature for such containers.

It is has further been desirable in containers in the prior art, upon such engagement of the lid with the container body, to form therebetween a nearly hermetic seal, such that the contents of the container will not be subjected to further infiltration of air, or to bacteria or other contaminants. Such packaging features have been especially desirable for the containing of comestible products therewithin, and especially for the containing of products which will require a resealable container for extraction of a second portion of such comestible from the container. Various sliced luncheon meats are some examples.

In addition to the desirability of an affirmatively functioning and "semi-hermetic" sealing mechanism, in the prior art it has likewise been desirable to have a container and matching lid combination structure which will not be unduly difficult or expensive to produce, which can be produced from presently available materials, and without the necessity for exotic machinery, but which will accomplish the desired results with a maximum of cost effectiveness.

In view of the above deficiencies and difficulties in regard to prior art matching lid and container combinations, it is a material object of the improved resealable container and matching substantially lockable lid combination of the present invention to alleviate materially the above difficulties and deficiencies of these such prior art lid and container combinations.

SUMMARY OF THE INVENTION

The present invention is directed to a matching lid and container combination to provide a resealable package, such as is especially usable for containing comestible products therewithin, and in particular utilizations for the containing of prepared luncheon meat products. Advantages of the improved resealable container and matching substantially lockable lid combination of the present invention include facilitative penetration of the lid lip into the container lip structure to produce a "spring loaded" seal, which will include an affirmative tactile response to indicate a manual assurance of sealing, and in preferred embodiments will further respond with an audible "pop" upon such sealing. Such improved combination invention of the present invention likewise produces a very tight, semi-hermetic seal. The above advantages features and functions of the present invention have been rendered possible because of the unique structures of the invention.

As set forth in greater detail, infra, the present invention is directed to an improved combination comprising an improved resealable container with a matching substantially lockable lid. The container includes a rounded container lip near the top extremity of the container. The matching lid includes a substantially rounded lid lip being slightly larger than the lip for the container and being of substantially the same shape. The transverse cross-sectional shape of the lid lip is that of a substantially smooth curve, and the transverse cross-sectional shape of the container lip for receiving, engaging and comprising the smooth curve of the lid lip is substantially widely V-shaped in order to exert force after engagement upon the smooth curve of the lid lip for effectuating a seal therebetween.

The above advantages of the improved resealable container and matching substantially lockable lid combination, along with other accompanying features and advantages, will become more apparent to those skilled in the art upon an examination of the following detailed description of the drawing, inter alia.

BRIEF DESCRIPTION OF THE DRAWING

The improved resealable container and matching substantially lockable lid combination of the present invention is set forth in the accompanying drawing, and in which.

DETAILED DESCRIPTION OF PREFERRED EMBODIMENTS

Figure 1:
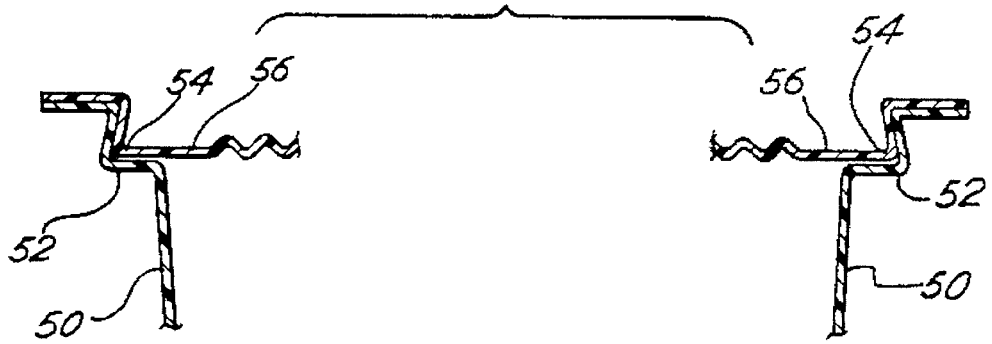
Fig. 1 PRIOR ART
FIG. 1 is a transverse cross-sectional partially fragmented view of a proposed resealable container and lockable lid which does not include the affirmative locking feature of preferred embodiments of the present invention.

The present invention is directed to a matching lid and container combination to provide a resealable package, such as may be especially usable for containing comestible products therewithin, and in particular for utilizations in the containing and storing of prepared luncheon meat products for example. Advantages of the improved resealable container and matching substantially lockable lid combination of the present invention include facilitative penetration of the lid lip into the container lip structure to produce a "spring loaded" seal, which will include an affirmative tactile response to indicate an assurance of sealing, and in preferred embodiments will respond with an audible "pop" upon such sealing. Such improved combination invention of the present invention likewise produces a very tight, or semi-hermetic, seal.

The present invention is directed to the combination of an improved resealable container and matching substantially lockable lid mechanism. The container hereof in preferred embodiments has a substantially rounded lip which defines a container opening having a selected shape and dimensions. The container lip is disposed in preferred embodiments at the top extremity of the container walls. The matching lid has a substantially rounded lid lip portion. In plan perspective such lid lip portion is of a shape and of dimensions which are substantially congruent with, but slightly larger than, the selected shape and dimensions of the container opening. Thus, during use the lid lip is adapted to snap over the container lip when force is applied to the lid to engage the container lip. In the preferred embodiments hereof, such engagement is affirmative and manually perceptible, and in other preferred embodiments is accompanied by an audible snapping noise or "pop," indicating that such affirmative engagement has occurred.

The lid lip of the present combination invention includes a substantially smooth curve as viewed in transverse cross-sectional view. Such lid has an upper inverted lip surface which extends radially inwardly from the smooth curve of the lip. The lid lip also has a manually grippable tab surface which extends radially outwardly from the smooth curve of the lid over at least a radial portion of the container lip for manual gripping thereof to unseal the container.

The container portion of the present combination invention has a lid lip compression and engagement mating surface. This compression and engagement mating surface extends in transverse cross-sectional view downwardly from the container lip and functions to receive, engage and compress the smooth curve of the lid lip therewithin to substantially, but removably, lock the lid into the container. The result in preferred embodiments is a very firm, tight, semi-hermetic seal which extends throughout the entire circumferential extent of the engagement surface between the container lip and lid lip.

Such lid lip compression and engagement mating surface means comprises in preferred embodiments a lid lip compression member formed of legs which are joined in a substantially widely V-shaped format in transverse cross-sectional view to receive, engage and compress at least a substantial portion of the smooth curve of the lid lip between said legs of said widely V-shaped member. At least one of the V-shaped lid compression member legs directs a compressive force against the smooth curve of the lid lip at an angle which is substantially perpendicular to the leg of the V-shaped member. In such preferred and other alternatively preferred embodiments, the V-shaped lid lip compression member legs direct respective compressive forces against the curve of the lip at respective angles, each of which angles is preferably substantially perpendicular to each of the respective legs of the compression surface. Also, in regard to such V-shaped lid lip compression members of the container hereof, the V-shaped lid lip compression member hereof first extend downwardly and radially outwardly from the container lip. Next, such V-shaped lid lip compression member extends at the joinder of the legs of the V-shaped lid lip compression member at a selected angle thereto, and further downwardly and radially inwardly with regard to such first leg thereof.

In such preferred embodiments, the rounded container lip has a selected radius. The exterior surface of the inverted lip surface of the lid is substantially the same size and shape as the interior surface of the container lip, to form a mating and snug engagement therewith when the lid is lockably engaged upon the container.

The inverted lid lip surface of the lid extends farther radially inwardly than does the smooth curve of the lid lip, which structure assists in the affirmative locking mechanism of the present combination invention. Such container lip extends farther inwardly than does the joinder of the legs of the V-shaped lid lip compression member in preferred embodiments. The selected angle between the legs of the widely V-shaped lid lip compression member is approximately but may be slightly greater than 90° in preferred embodiments. The second downwardly extending leg of the V-shaped lid lip compression member is attached to the upper extent of the sidewall of the container and is disposed at a substantially obtuse angle to the sidewall of the container to form thereby a funnel for directing the entry of contents into the container.

Also, in preferred embodiments, both the container lid and the mating lid lip may be circular in plan view, although other shapes are contemplated herein.

During engagement, the smooth curve of the lid lip is compressed at a portion of such curve into a substantially flat shape, and in preferred embodiments engages a substantial portion Of the interior surface of at least one leg of the V-shaped compression member, and in these preferred embodiments does so throughout the entire circumferential extent thereof to effectuate such semi-hermetic sealing function. Further included in such preferred embodiments are compression spring means disposed radially interiorly of the lid lip. Such compression means may preferably comprise corrugations, or baffles, which are disposed in radially concentrically array on such lid.

Referring now to the drawing, in particular, the present invention is directed to a matching lid and container combination generally 10 to provide a resealable package, such as is especially usable for containing comestible products therewithin, and in particular utilizations for the containing of prepared luncheon meats, cheese, and other sliced food products, for example. The container 12 hereof has a bottom 14 and sidewalls 16, and further has a substantially rounded container lip 18 which defines a container opening 20 having a selected shape and dimensions. The container lip 18 is disposed in preferred embodiments at the top extremity 22 of container walls 16.

Figure 2:
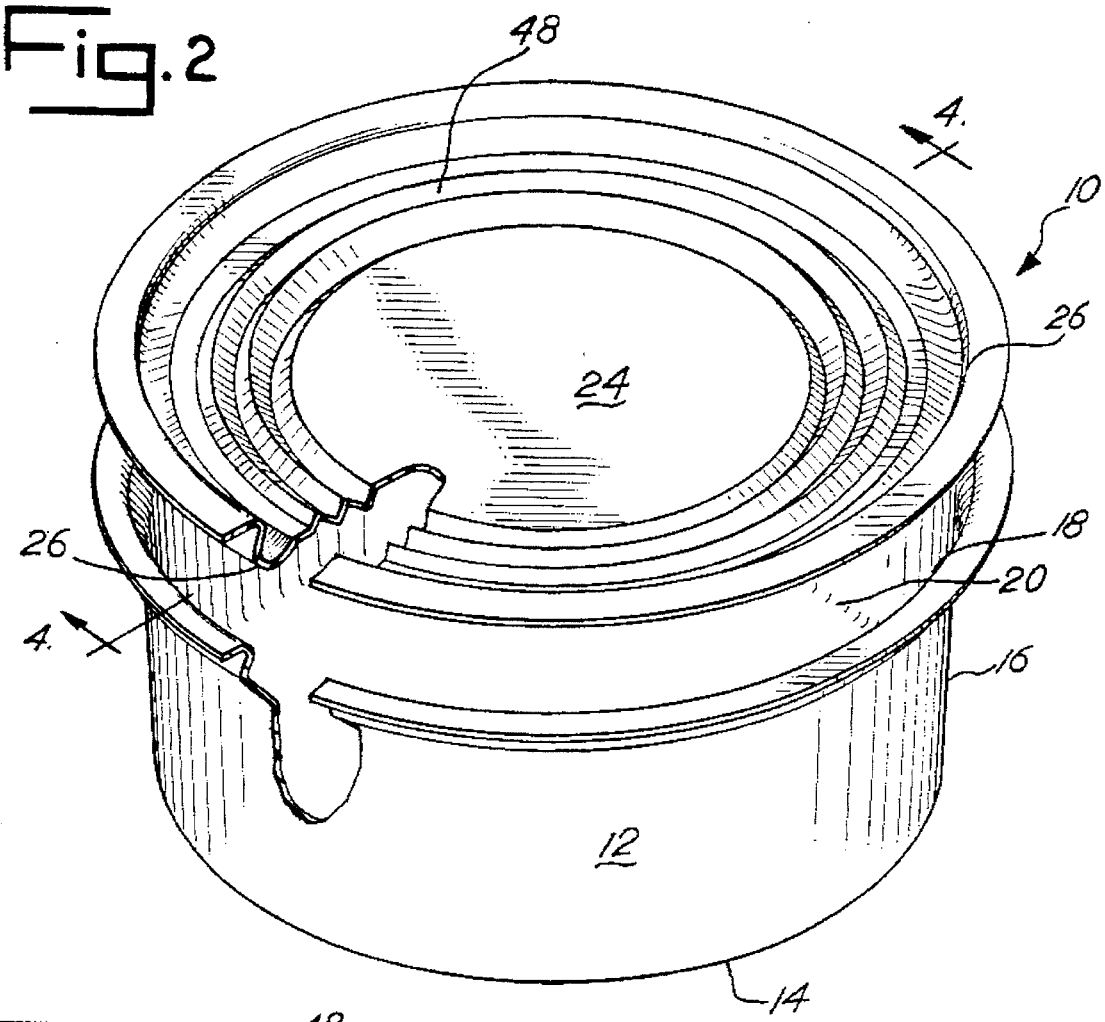
FIG. 2 is a perspective view of the improved resealable container and matching lockable lid combination of the present invention in disengaged disposition, showing the substantially rounded container lip defining a container opening, and further showing the accompanying lid having a substantially rounded lip and being of substantially congruent shape in dimensions which are but slightly larger than the selected shape and dimensions of the container opening.
Figure 3:
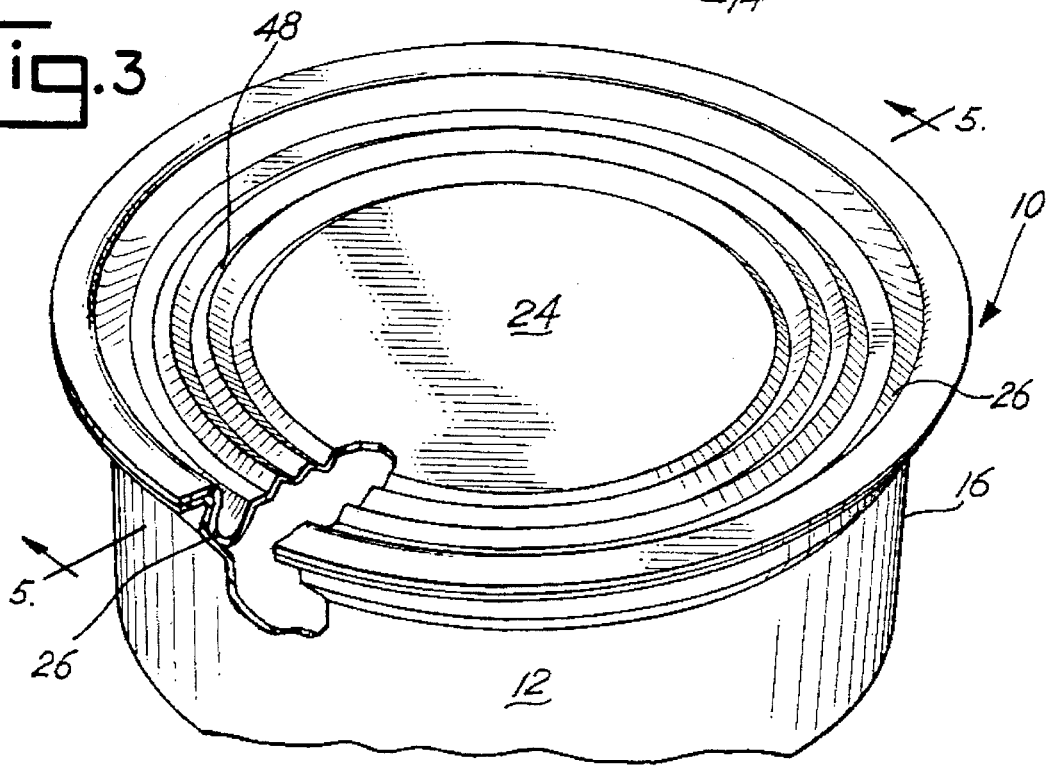
FIG. 3 is a perspective review of the improved resealable container and matching lid combination as shown in FIG. 2, but shown in engaged disposition.

As in perspective of FIGS. 2 and 3, the matching lid 24 also has a substantially rounded lid lip 26. Such lid lip 26 is of a shape and dimensions which arc substantially congruent with, but slightly larger than, the selected shape and dimensions of container opening 20. Thus, during use lid lip 26 is adapted to snap over the container lip 18 when force is applied to lid 24 when engaging container lip 18. In these preferred embodiments, such engagement is affirmative and manually perceptible, and in other preferred embodiments is accompanied by an audible snapping noise indicating that such affirmative engagement has occurred.

Figure 4:
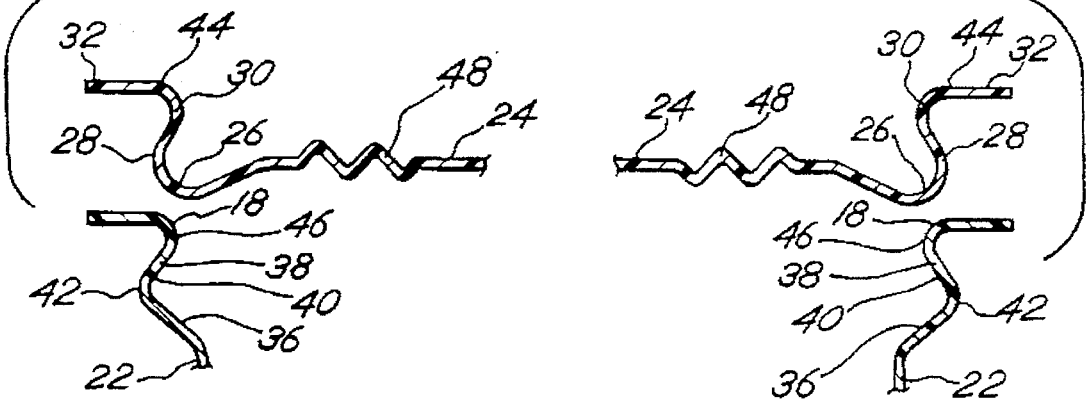
FIG. 4 is an exploded cross-sectional partially fragmented view of the top wall portion of the resealable container taken along lines 4—4 of FIG. 2, showing the lip portion thereof, further showing a truncated cross-sectional view of the matching lid lip, and yet further showing the corrugated spring element, or baffle, contained within the body of the lid, such lid having a smoothly rounded surface to fit within essentially widely V-shaped container lid lip elements to receive, engage and compress the smooth curve of the lid lip.
Figure 5:
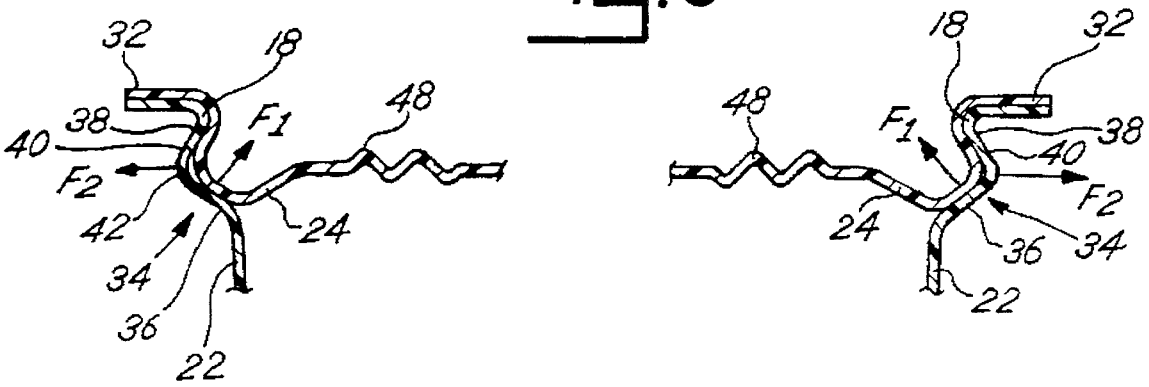
FIG. 5 is a transverse cross-sectional partially fragmented view taken along lines 5— 5 of FIG. 3, showing engagement of the matching lockable lid lip of the container and showing the compression of the lid lip within such widely V-shaped compression, receiving and engaging member of the container lip to exert a first force in a direction $F_1$, and a second force in a second direction $F_2$, for creating a sealing surface around the entire circumferential extent of the matching lid lip and container lip elements for maintaining a semi-hermetic seal thereabout.

Lid lip 26 of the present combination invention includes a substantially smooth curve 28 as viewed in transverse cross-sectional view as shown in FIGS. 4 and 5. Such lid 24 has an upper inverted lip surface 30 which extends first radially inwardly from the smooth curve of the lip 28. Lid lip 26 also has a manually grippable tab surface 32 which extends radially outwardly from inverted lid surface 30 over at least a radial portion of container lip 18 for manual gripping thereof during unsealing of container 12.

The container portion 12 of the present combination invention has a lid lip compression and engagement mating surface generally 34. Such compression and engagement mating surface 34 extends in transverse cross-sectional view downwardly from container lip 18 and functions to receive, engage and compress smooth curve 28 of lid lip 26 therewithin to substantially, but removably, lock lid 24 into container 12. The result in preferred embodiments is a semi-hermetic seal which extends throughout the entire circumferential extent of the engagement between container lip 18 and lid lip 26.

Lid lip compression and engagement mating surface 34 comprises in preferred embodiments a lid lip compression member formed of legs 36, 38 which are substantially but widely V-shaped in transverse cross-sectional view, to receive, engage and compress at least a substantial portion of smooth curve 28 of lip 26 between legs 36, 38 of V-shaped member 40. As shown in FIG. 5, one of V-shaped lid compression member legs 36 directs a compressive force $F_1$ against smooth curve 28 of lid lip 26 at an angle which is preferably substantially perpendicular to leg 36 of V-shaped member 40. Also as shown in FIG. 5, V-shaped lid lip compression member leg 38 also exerts a compressive force $F_2$ against smooth curve 28 of lid lip 26 at an angle which is also substantially perpendicular to leg 38. Also, V-shaped lid lip compression member 40 first extends downwardly and radially outwardly from container lip 18 to form leg 38. Thereafter, V-shaped lid lip compression member 40 extends at the joinder 42 of less 36, 38 of V-shaped lid lip compression member 40 at a selected angle thereto and further downwardly and radially inwardly to form leg 36.

In some embodiments the lid lip compression and mating surface means comprising V-shaped lid lip compression member 40 is continuously circumferentially disposed about the container lip 18. However, in other preferred embodiments the V-shaped lid lip compression member 40 is discontinuously disposed about the circumference of container lip 18. In those embodiments, a plurality of substantially straight container wall sides are disposed between the plurality of the circumferentially V-shaped members 40.

Rounded container lip 18 has a selected radius. As shown in FIG. 4, exterior surface 44 of inverted lip surface 30 of lid 24 is substantially the same size and shape as the interior surface 46 of container lip 18 to form a mating and snug engagement therewith when lid 24 is lockably engaged upon container 12.

Inverted lid lip surface 30 of lid 24 extends farther radially inwardly than does smooth curve 28 of lid lip 26 which assists in the affirmative locking mechanism of the present combination invention. Container lip 18 extends farther inwardly than does joinder 42 of legs 36, 38 of V-shaped lid lip compression member 40. The selected angle between legs 36, 38 of V-shaped lid lip compression member 40 is preferably approximately 90°, but may be slightly greater than 90°, although other smaller angles are contemplated depending, inter alia, upon the size of the mating smooth curve 20. In other preferred embodiments the selected angle between legs 36, 38 of V-shaped lid lip compression member 40 may be substantially greater than 90°. In some of those and other embodiments of the present invention leg 36 may be of a longer length than leg 38. In such embodiments, smooth curve 28 of lid lip 26 may be compressed only against leg 36 of the V-shaped lid lip compression member 40. An important feature of the present invention in accomplishing such locking is that the diameter of lid lip 26 be less than the diameter than the container lip 18. Smooth curve of lid lip 26 may constitute continuous radius, such for example a segment of a circle in cross-section, or in other embodiments smooth curve 28 of lid lip 26 may be of other smooth curves including semi-elliptical or semi-oblong shapes in transverse cross-section.

Downwardly extending leg 36 of V-shaped lid lip compression member 40 is attached to sidewall 16 of container 12 and is disposed at a substantially obtuse angle to sidewall 16 of container 12 to form thereby funnel means for directing the entry of contents into container 12. Lid 24 may have corrugations 48 for providing compression spring means to the locking engagement functioning of the present invention.

FIG. 1 illustrates the lesser utility of combination lid and container structures which do not incorporate the desirable features of the invention hereof. In particular, container wall 50 thereof has a V-shaped lid engagement member 52. However, the mating lid lip surface 54 of the accompanying lid 56 is not configured as a distortable smooth curve having dimensions which will be compressed within the V-shaped lid engagement member 52. Moreover, the angle of V-shaped lid engagement member 52 is substantially less than 90°, while at the same time lid lip surface 54 merely matches the interior contours of V-shaped lid engagement member 52. The net result is failure to achieve a substantial seal therebetween, in direct contrast to that of the combination present invention.

The materials used for container 12 and lid 24 hereof are in general polymeric materials which are known to those having ordinary skill in the relevant art.

The improved resealable container 12 and matching lockable lid 24 components of the present invention may be formed as separate components on separate machines and brought together thereafter for assembly. In other embodiments of the present invention, such container 12 and lid 24 may be formed "in-line"—i.e., made, filled, assembled, and sealed on the same machines. One example of methods and apparatus for carrying out such "in-line" container component manufacture, filling with product, assembly of components, and sealing thereof is set forth in the applicants' U.S. Pat. No. 5,054,266 which is entitled "Vacuum Seal Station for a Vacuum Packaging Machine", the teachings of which are incorporated by reference herein. Of course, other "in-line" methods and apparatus may be utilized for such purposes.

The basic and novel characteristics of the improved methods and apparatus of the present invention will be readily understood from the foregoing disclosure by those skilled in the art. It will become readily apparent that various changes and modifications may be made in the form, construction and arrangement of the improved apparatus of the present invention, and in the steps of the inventive methods hereof, which various respective inventions are as set forth hereinabove without departing from the spirit and scope of such inventions. Accordingly, the preferred and alternative embodiments of the present invention set forth hereinabove are not intended to limit such spirit and scope in any way.

What is claimed is:

1. The improved method of packaging a non-fluid food product comprising the steps of:

forming a container having a recloseable lockable container lip portion extending substantially circumferentially around the entirety of the circumference of said recloseable lockable container lip portion, and a sealing flange exterior thereto from a first continuous web of polymeric material;

placing the non-fluid food product within the container only;

separately forming a lid from a second continuous web of polymeric material, said lid having a corresponding recloseably lockable lid lip portion extending substantially circumferentially around the entirety of the circumference of said recloseably lockable lid lip portion, said lid lip portion recloseably lockable with the corresponding recloseably lockable container lip portion and having a sealing flange disposed exterior to said recloseably lockable lid lip portion;

placing said second continuous web carrying said lid in registry with said first continuous web carrying said container containing the non-fluid food product;

locking the respective corresponding recloseable lockable container lip portion of the container with the recloseably lockable lid lip portion of the lid said lockable portions extending and recloseably locking substantially continuously around the circumference of the lid of the package; and sealing together said respective sealing flanges of said container and lid.

2. The improved method of packaging a product comprising the steps of claim 1 and further including the step of positioning said lid and said container within a vacuum chamber.

3. The improved method of packaging a product comprising the steps of claim 1 and further including the step of compressing said product within said container to eliminate free air space both integrally and vertically by engaging the central portion of said lid.

4. The improved method of packaging a product comprising the steps of claim 1 and further including the step of vacuumizing said chamber.

5. The improved method of packaging a product comprising the steps of claim 1 wherein the container and the lid are continuously formed.

6. The improved method of packaging a product of claim 1 wherein the food is a prepared meat product.

7. The improved method of packaging a product of claim 1 wherein the lockable lid lip portion of the lid is substantially congruent in shape and dimensions with the corresponding lockable container lip portion of the container and further comprising the step of congruently locking together the substantially congruent lid lip and container lip portion respectively of the lid and the container.

8. The improved method of packaging a product of claim 7 wherein the step of congruently locking together the lid lip and container lip portions includes receiving, engaging and compressing the lid lip portion of the lid within the congruent container lip portion of the container.

9. The improved method of packaging a product of claim 1 wherein said lip has a peripheral flange, a central portion and flexible means connecting the central portion to said flange.

10. The improved method of packaging a product of claim 1 wherein the lockable lid portion of the lid is resiliently and flexibly locked together with the corresponding container lip portion.

11. The improved method of claim 1 comprising the further step of simultaneously cutting both the container and the lid from their respective webs.

12. The improved method of packaging a non-fluid food product comprising the steps of:

feeding first and second polymeric webs to a single sealing station;

preforming from said first polymeric web a container having a recloseably lockable portion thereof extending substantially circumferentially around the entirety of the circumference of said recloseable lockable container lip portion;

preforming from said second polymeric web a lid having a recloseably lockable portion thereof extending substantially circumferentially around the entirety of the circumference of said recloseably lockable lid lip portion;

placing the non-fluid food product within the container only;

placing the lid on the container containing the non-fluid product and while the container and lid remain attached to their respective webs;

locking the respective recloseably lockable portions of said container and said lid, said lockable portions extending and recloseably locking substantially continuously around the circumference of the lid of the package; and sealing the lid to the container adjacent said respectively recloseably lockable portions of said lid and said container.

13. The improved method of claim 12 comprising the further step of simultaneously cutting both the container and the lid from their respective webs.

14. The improved method of packaging a product comprising the steps of claim 12 and further disposing the continuous web including the containers formed thereon into substantially horizontal disposition prior to placing the product within the container.

15. The improved method of packaging a non-fluid food product comprising the steps of:

feeding a first unmetallized polymeric web and a second unmetallized polymeric web to a single sealing station;

preforming from said first polymeric web a container having a recloseably lockable portion thereof extending substantially circumferentially around the entirety of the circumference of said recloseable lockable container lip portion;

preforming from said second polymeric web a lid having a recloseably lockable portion thereof extending substantially circumferentially around the entirety of the circumference of said recloseably lockable lid lip portion;

placing the non-fluid food product within the container only;

placing the lid on the container containing the non-fluid product and while the container and lid remain attached to their respective webs;

locking the respective recloseably lockable portion of said lid to said recloseably lockable portion of said container, said lockable portions extending and recloseably locking substantially continuously around the circumference of the lid of the package;

sealing the lid to the container adjacent said respective recloseably lockable portions of said lid and said container.

16. The improved method of claim 2 further comprising the steps of;

vacuumizing said chamber while retaining in substantially non-collapsed array the as formed structures of both the container and the lid respectively formed on such polymeric webs; and compressing said non-fluid product within the container to deform said product laterally and vertically to eliminate free space both laterally and vertically.

17. The improved method of claim 16 wherein the feeding of polymeric webs comprises the feeding of a first unmetallized polymeric web and a second unmetallized polymeric web to a single sealing station.

18. The improved method of claim 16 wherein the feeding of polymeric webs comprises the feeing of a first unmetallized polymeric web and a second metallized polymeric web to a single sealling station.

* * * * *